US006648743B1

(12) United States Patent
Burke

(10) Patent No.: US 6,648,743 B1
(45) Date of Patent: Nov. 18, 2003

(54) CHEMICAL MECHANICAL POLISHING PAD

(75) Inventor: Peter A. Burke, Portland, OR (US)

(73) Assignee: LSI Logic Corporation, Milpitas, CA (US)

( * ) Notice: Subject to any disclaimer, the term of this patent is extended or adjusted under 35 U.S.C. 154(b) by 133 days.

(21) Appl. No.: 09/946,253

(22) Filed: Sep. 5, 2001

(51) Int. Cl.[7] ..... B24D 11/00

(52) U.S. Cl. ..... 451/526; 451/527; 451/528; 451/529

(58) Field of Search ..... 451/285, 290, 451/526, 527, 528, 529

(56) References Cited

U.S. PATENT DOCUMENTS

| | | | | | |
|---|---|---|---|---|---|
| 5,177,908 | A | * | 1/1993 | Tuttle | 451/41 |
| 5,177,910 | A | * | 1/1993 | Norota et al. | 451/529 |
| 5,653,624 | A | | 8/1997 | Ishikawa et al. | |
| 5,655,954 | A | | 8/1997 | Oishi et al. | |
| 5,871,393 | A | | 2/1999 | Shiozawa | |
| 5,882,251 | A | * | 3/1999 | Berman et al. | 451/527 |
| 5,888,121 | A | * | 3/1999 | Kirchner et al. | 451/41 |
| 5,975,994 | A | | 11/1999 | Sandhu et al. | |
| 5,984,769 | A | * | 11/1999 | Bennett et al. | 451/527 |
| 6,089,966 | A | * | 7/2000 | Arai et al. | 451/533 |
| 6,099,394 | A | * | 8/2000 | James et al. | 451/72 |
| 6,106,369 | A | | 8/2000 | Konishi et al. | |
| 6,159,088 | A | * | 12/2000 | Nakajima | 451/527 |
| 6,241,596 | B1 | * | 6/2001 | Osterheld et al. | 451/527 |
| 6,261,168 | B1 | * | 7/2001 | Jensen et al. | 451/527 |
| 6,331,137 | B1 | * | 12/2001 | Raeder et al. | 451/285 |
| 6,332,832 | B1 | * | 12/2001 | Suzuki | 451/41 |
| 6,402,594 | B1 | * | 6/2002 | Kobayashi et al. | 451/41 |
| 6,500,054 | B1 | * | 12/2002 | Ma et al. | 451/56 |
| 2001/0044263 | A1 | * | 11/2001 | Andideh et al. | 451/51 |

FOREIGN PATENT DOCUMENTS

| | | | |
|---|---|---|---|
| JP | 2002-246343 | * | 8/2002 |
| WO | WO 02/02279 A2 | * | 1/2002 |

* cited by examiner

*Primary Examiner*—M. Rachuba
(74) *Attorney, Agent, or Firm*—Luedeka, Neely & Graham PC

(57) ABSTRACT

A polishing pad for use in chemical mechanical polishing of a semiconductor substrate is described. The polishing pad comprises a substantially flat disk having a polishing surface for contacting the substrate. The polishing surface, which has a central region and a peripheral region, is segmented by a set of substantially parallel linear grooves. The grooves include central grooves which traverse the central region of the polishing surface, and peripheral grooves which traverse the peripheral region of the polishing surface. The central grooves have central groove dimensions, including a central groove width and pitch. The peripheral grooves have peripheral groove dimensions, including a peripheral groove width and pitch. At least one of the central groove dimensions, i.e. the width or the pitch, is different from the corresponding peripheral groove dimension. This difference in groove dimensions from the center to the edge of the polishing surface introduces a difference in the polishing surface area provided near the peripheral region as compared to the central region of the pad. As the polishing pad spins in relation to the substrate being processed, the variation in polishing surface area across the polishing surface results in a difference in the rate of material removal near the periphery of the substrate as compared to the rate of material removal near the substrate center. Thus, by providing a variation in the width or pitch of the grooves across the polishing surface of the pad, the invention provides for a corresponding radial variation in the polishing rate distribution across the polishing surface.

21 Claims, 4 Drawing Sheets

(Section I-I)

(Section II-II)

CHEMICAL MECHANICAL POLISHING PAD

FIELD

This invention relates to integrated circuit processing. More particularly the invention relates to a polishing pad for use in chemical mechanical polishing of integrated circuit substrates.

BACKGROUND

Chemical mechanical polishing is used to planarize substrates, such as semiconductor substrates. Planarization is often performed between process steps to remove unwanted material and to reduce problems in step coverage during subsequent processing. Typically, chemical mechanical polishing is performed after circuit devices are partially formed on the substrate, but before the substrate is diced and the devices on the substrate are separated one from another.

During chemical mechanical polishing, a polishing pad is brought into contact with a surface of the substrate where devices are formed. A polishing slurry may be applied between the polishing pad and the substrate, and the substrate and pad are moved relative to each other, typically by spinning the pad in relation to the substrate. The slurry acts upon the substrate to both chemically etch and mechanically wear the surface of the substrate. The movement between the substrate and pad helps provide a uniform removal of material at the surface of the substrate.

Great care must be taken during chemical mechanical polishing to ensure that the substrate layer being planarized is thinned to within a predetermined range, or else devices formed in the layer may not function properly. Thus, it is typically desired to remove material evenly across the surface of the substrate during planarization. When the surface of an incoming substrate has a non flat profile, it is difficult to maintain even material removal across the surface of the substrate during polishing. For example, prior to planarization, an incoming substrate may have a surface profile which is higher on the edges and lower in the center. In this situation, it may be desirable to remove more material at the edges of the substrate than is removed near the center of the substrate. Generally, to remove more material at the edges than at the center, the polishing rate distribution must be adjusted to provide a higher polishing rate at the edges of the substrate than at the center.

Prior attempts at adjusting the polishing rate distribution in a chemical mechanical polishing process have been cost prohibitive and difficult to implement.

What is needed, therefore, is an uncomplicated and cost effective solution for adjusting the polishing rate distribution of a chemical mechanical polishing pad to account for non flat surface profiles on incoming substrates, such as those used for integrated circuits.

SUMMARY

The above and other needs are met by a polishing pad for use in chemical mechanical polishing of a substrate. The polishing pad comprises a substantially flat disk having a polishing surface for contacting the substrate. The polishing surface, which has a central region and a peripheral region, is segmented by a set of substantially parallel linear grooves. The grooves include central grooves which traverse the central region of the polishing surface, and peripheral grooves which traverse the peripheral region of the polishing surface. The central grooves have central groove dimensions, including a central groove width and pitch, and the peripheral grooves have peripheral groove dimensions, including a peripheral groove width and pitch.

According to the invention, at least one of the central groove dimensions, such as either or both of the width or the pitch, is different from the corresponding peripheral groove dimension. This difference in groove dimensions from the center to the edge of the polishing surface introduces a difference in the polishing surface area provided near the peripheral region of the pad as compared to the central region of the pad. As the polishing pad spins in relation to the substrate being processed, the variation in polishing surface area across the polishing surface results in a difference in the rate of material removal near the periphery of the substrate as compared to the rate of material removal near the substrate center. Thus, the invention provides a radial variation in the polishing rate distribution across the polishing surface of the pad by providing a corresponding variation in the width or pitch of the grooves in the polishing surface.

In a most preferred embodiment of the invention, the grooves include a first set of substantially parallel linear grooves directed in a first direction and a second set of substantially parallel linear grooves directed in a second direction that is different from the first direction. The first set of grooves includes first central grooves and first peripheral grooves. The first central grooves, which traverse the central region of the polishing surface, have first central groove dimensions, including a first central groove width and pitch. The first peripheral grooves, which traverse the peripheral region of the polishing surface, have first peripheral groove dimensions, including a first peripheral groove width and pitch.

The second set of grooves includes second central grooves and second peripheral grooves. The second central grooves, which traverse the central region of the polishing surface, have second central groove dimensions, including a second central groove width and pitch. The second peripheral grooves, which traverse the peripheral region of the polishing surface, have second peripheral groove dimensions, including a second peripheral groove width and pitch. In preferred embodiments of the invention, at least one of the first central groove dimensions, such as one or both of the width or the pitch, is different from the corresponding first peripheral groove dimension, and at least one of the second central groove dimensions is different from the corresponding second peripheral groove dimension.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1A:
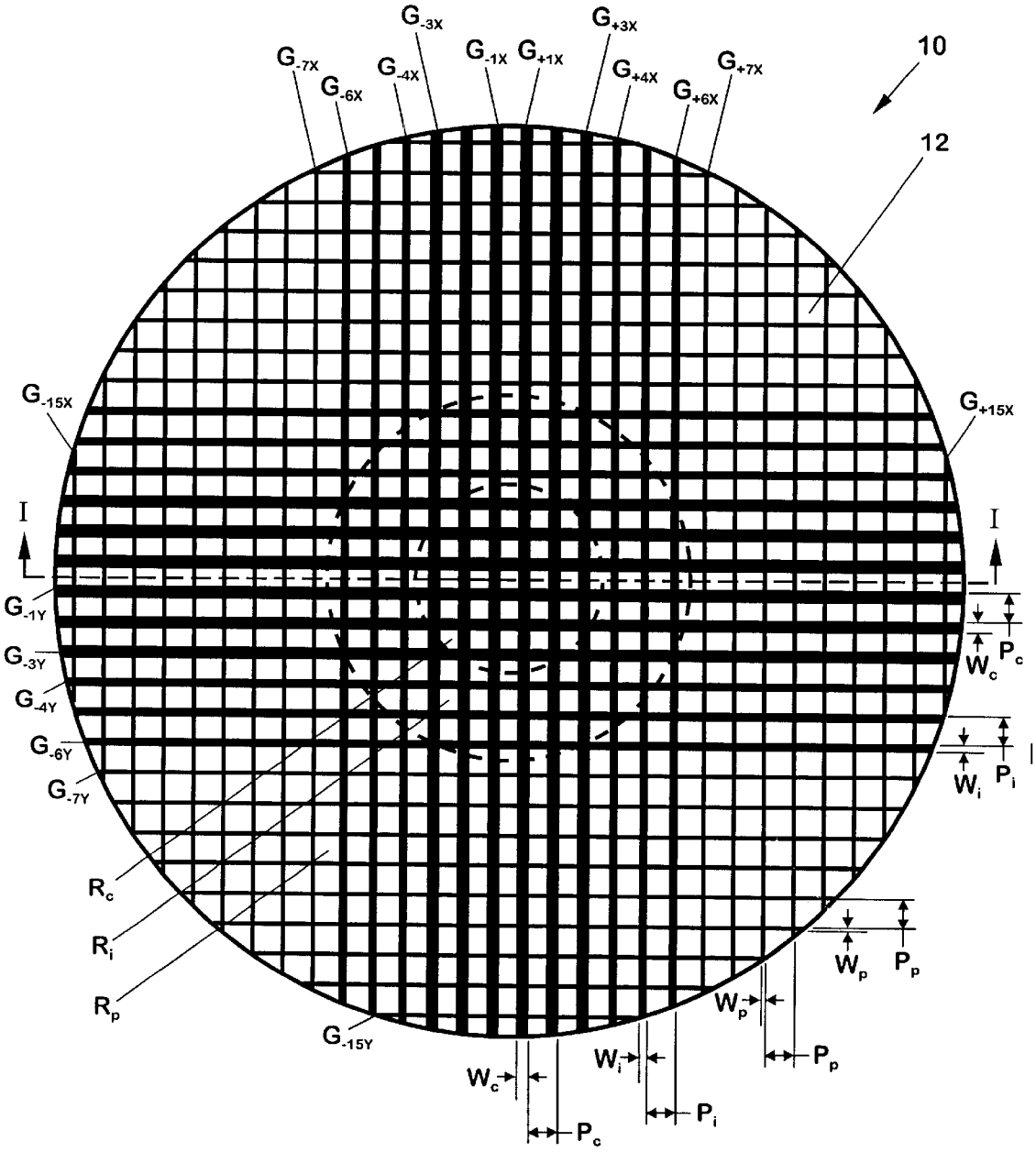
FIG. 1A depicts a plan view of a polishing pad according to a preferred embodiment of the present invention.
Figure 1B:
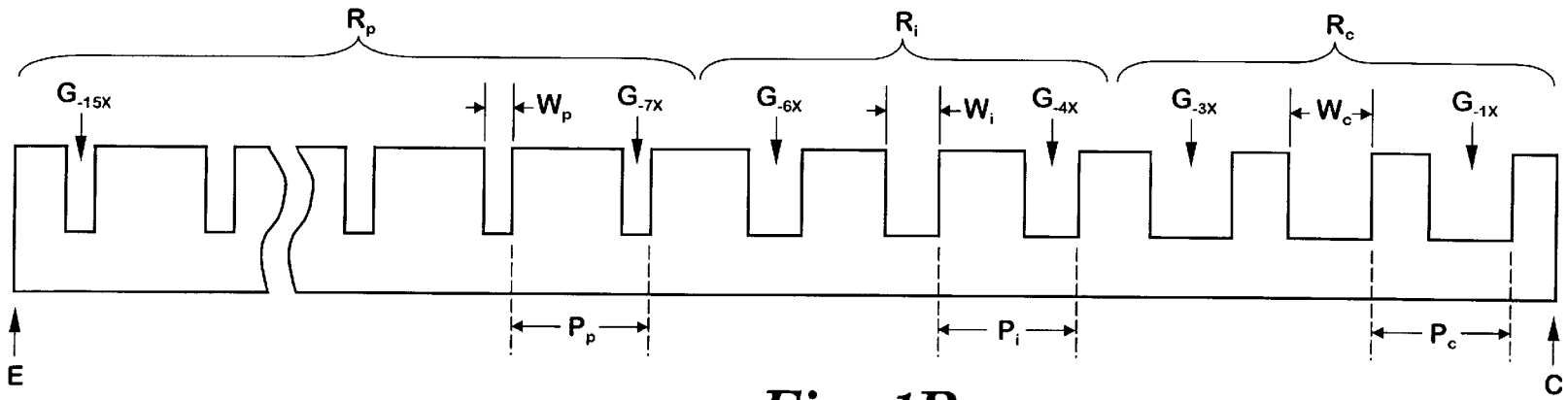
FIG. 1B depicts a cross sectional view of a polishing pad according to a preferred embodiment of the present invention.

Referring now to FIGS. 1A and 1B, there is depicted a preferred embodiment of a polishing pad 10, such as is used in an orbital polishing apparatus. As depicted in FIG. 1A, the preferred embodiment of the pad 10 is substantially circular, having a diameter of approximately ten inches. The pad 10 has a polishing surface 12 within which a series of substantially linear parallel horizontal and vertical grooves are formed. In the embodiment of FIG. 1A, there are thirty horizontal grooves $G_{-15Y}$–$G_{+15Y}$, and thirty vertical grooves $G_{-15X}$–$G_{+15X}$. It will be appreciated, though, that the invention is not limited to any particular number of grooves. FIG. 1B depicts a cross sectional view of one half of the pad 10 along section line I—I (see FIG. 1A) from the left edge E to the center C of the pad 10.

To aid in describing the configuration of the grooves in the pad 10, the pad 10 is described as having three different regions, the approximate boundaries of which are indicated by the dashed circles in FIG. 1A. These regions include a central region $R_c$, an intermediate region $R_i$, and a peripheral region $R_p$.

As shown in FIGS. 1A and 1B, the width of the vertical grooves $G_{-15X}$–$G_{-1X}$ varies from the edge E to the center C of the pad 10. For example, the width $W_p$ of the grooves $G_{-15X}$–$G_{-7X}$ which traverse the peripheral region $R_p$ of the pad 10 is less than the width $W_i$ of the grooves $G_{-6X}$–$G_{-4X}$ which traverse the intermediate region $R_i$, and the width $W_i$ of the grooves $G_{-6X}$–$G_{-4X}$ is less than the width $W_c$ of the grooves $G_{-3X}$–$G_{-1X}$ which traverse the central region $R_c$. As shown in FIG. 1A, this variation in groove width is reflected on the other horizontal half of the pad 10 for the vertical grooves $G_{+1X}$–$G_{+15X}$. Similarly, as shown in FIG. 1A, the horizontal grooves $G_{-15Y}$–$G_{+15Y}$ preferably have the same variation in width across the surface of the pad 10.

In the embodiment of FIGS. 1A and 1B, the pitch (center-to-center spacing) of the grooves is preferably constant across the surface of the pad 10. Thus, the pitch $P_p$ of the peripheral vertical grooves $G_{-15X}$–$G_{-7X}$ and $G_{+7X}$–$G_{+15X}$ is substantially equivalent to the pitch $P_i$ of the intermediate vertical grooves $G_{-6X}$–$G_{-4X}$ and $G_{+4X}$–$G_{+6X}$, which is substantially equivalent to the pitch $P_c$ of the central vertical grooves $G_{-3X}$–$G_{-1X}$ and $G_{+1X}$–$G_{+3X}$. Similarly, the pitch $P_p$ of the peripheral horizontal grooves $G_{-15Y}$–$G_{-7Y}$ and $G_{+7Y}$–$G_{+15Y}$ is substantially equivalent to the pitch $P_i$ of the intermediate horizontal grooves $G_{-6Y}$–$G_{-4Y}$ and $G_{+4Y}$–$G_{+6Y}$, which is substantially equivalent to the pitch $P_c$ of the central horizontal grooves $G_{-3Y}$–$G_{-1Y}$ and $G_{+1Y}$–$G_{+3Y}$.

As indicated most clearly in FIG. 1A, this preferred variation in groove width across the surface 12 of the pad 10 provides for more polishing surface area near the periphery of the pad 10 than there is near the center of the pad 10. With this distribution of polishing surface area, the rate of material removal near the periphery of the substrate is higher than the rate of material removal near the substrate center. Thus, the embodiment of the invention depicted in FIGS. 1A and 1B provides a radial variation in the polishing rate distribution across the surface 12 of the pad 10 due to a corresponding variation in the width of the grooves $G_{-15Y}$–$G_{+15Y}$ and $G_{-15X}$–$G_{+15X}$ in the surface 12 of the pad 10.

Figure 2B:
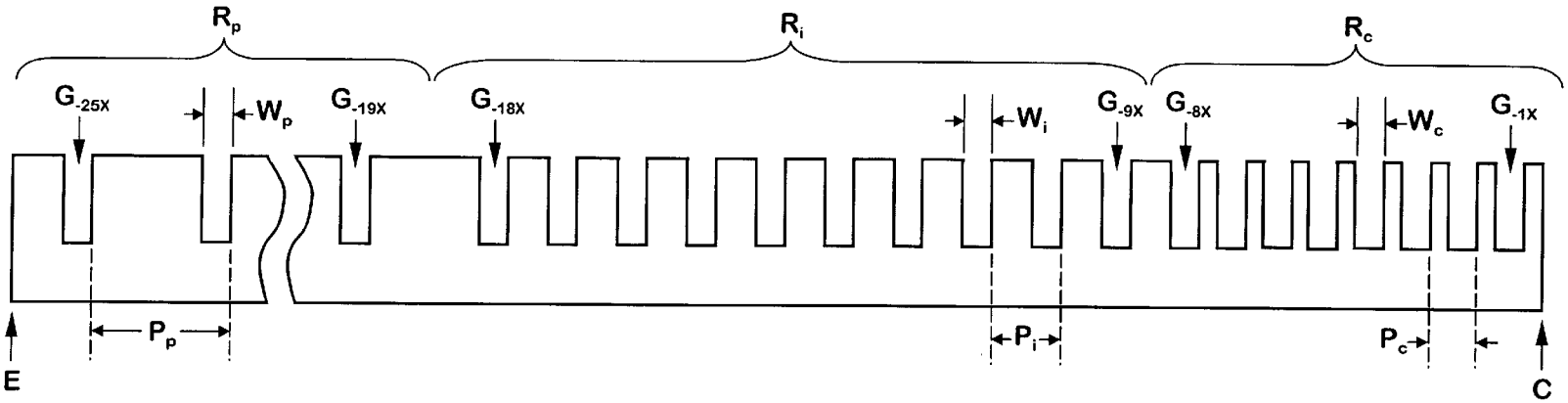
FIG. 2B depicts a cross sectional view of a polishing pad according to an alternate embodiment of the present invention.
Figure 2A:
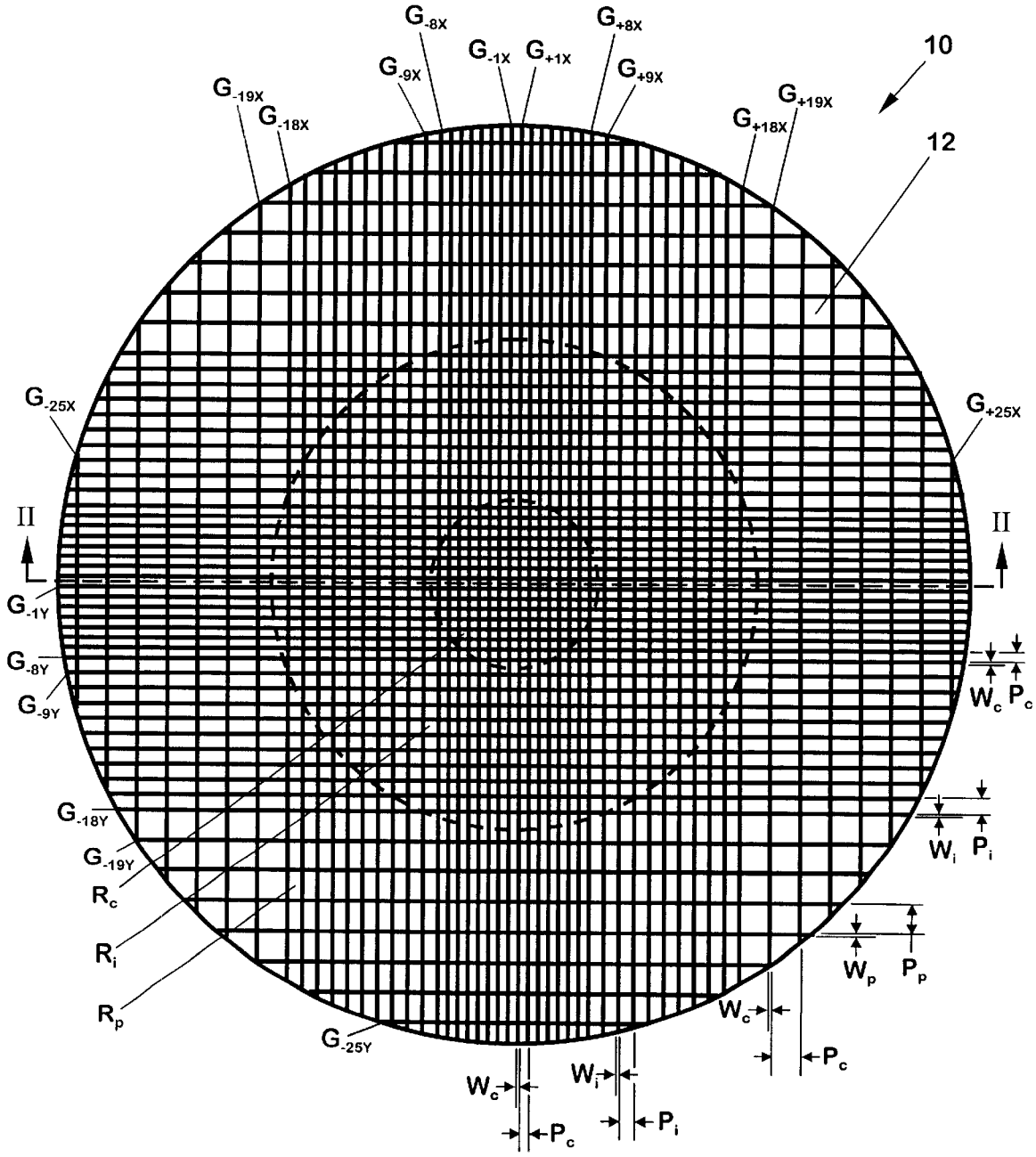
FIG. 2A depicts a plan view of a polishing pad according to an alternate embodiment of the present invention.

Another embodiment of the invention, as depicted in FIGS. 2A and 2B, has fifty horizontal grooves $G_{-25Y}$–$G_{+25Y}$, and fifty vertical grooves $G_{-25X}$–$G_{+25X}$. It will be appreciated, though, that more or fewer grooves could be used. Thus, the invention is not limited to any particular number of grooves. FIG. 2B depicts a cross sectional view of one half of the pad 10 along section line II—II (see FIG. 2A) from the left edge E to the center C of the pad 10.

As shown in FIGS. 2A and 2B, the pitch of the vertical grooves $G_{-25X}$–$G_{-2X}$ of this embodiment varies from the edge E to the center C. For example, the pitch $P_p$ of the grooves $G_{-25X}$–$G_{-19X}$ which traverse the peripheral region $R_p$ of the pad 10 is greater than the pitch $P_i$ of the grooves $G_{-18X}$–$G_{-9X}$ which traverse the intermediate region $R_i$, and the pitch $P_i$ of the grooves $G_{-18X}$–$G_{-9X}$ is greater than the pitch $P_c$ of the grooves $G_{-8X}$–$G_{-1X}$ which traverse the central region $R_c$. As shown in FIG. 2A, this variation in groove pitch is reflected on the other horizontal half of the pad 10 for the vertical grooves $G_{+1X}$–$G_{+25X}$. Similarly, as shown in FIG. 2A, the horizontal grooves $G_{-25Y}$–$G_{+25Y}$ preferably have the same variation in pitch across the surface of the pad 10.

In the embodiment of FIGS. 2A and 2B, the width of the grooves is preferably constant across the surface of the pad 10. Thus, the width $W_p$ of the peripheral vertical grooves $G_{-25X}$–$G_{-19X}$ and $G_{+19X}$–$G_{+25X}$ is substantially equivalent to the width $W_i$ of the intermediate vertical grooves $G_{-18X}$–$G_{-9X}$ and $G_{+9X}$–$G_{+18X}$, which is substantially equivalent to the width $W_c$ of the central vertical grooves $G_{-8X}$–$G_{1X}$ and $G_{+1X}$–$G_{+8X}$ Similarly, the width $W_p$ of the peripheral horizontal grooves $G_{-25Y}$–$G_{-19Y}$ and $G_{+19Y}$–$G_{+25Y}$ is substantially equivalent to the width $W_i$ of the intermediate horizontal grooves $G_{-18Y}$–$G_{-9Y}$ and $G_{+9Y}$–$G_{+18Y}$, which is substantially equivalent to the width $W_c$ of the central horizontal grooves $G_{-8Y}$–$G_{-1Y}$ and $G_{+1Y}$–$G_{+8Y}$.

As indicated most clearly in FIG. 2A, this preferred variation in groove pitch across the surface 12 of the pad 10 also provides for more polishing surface area near the periphery of the pad 10 than there is near the center of the pad 10. Thus, the embodiment of the invention depicted in FIGS. 2A and 2B also provides for a radial variation in the polishing rate distribution across the surface 12 of the pad 10 by a corresponding variation in the pitch of the grooves $G_{-25Y}$–$G_{+25Y}$ and $G_{-25X}$–$G_{+25X}$ in the surface 12 of the pad 10.

In the preferred embodiments of the invention described above, the radial variation in polishing rate distribution is accomplished using only linear horizontal and vertical grooves in the surface 12 of the pad 10. Thus, fabrication of the pad 10 is straightforward, requiring no complicated radial cuts as are found in prior polishing pads.

One skilled in the art will appreciate that other embodiments of the invention may include other variations in groove width and pitch to provide other polishing rate distribution profiles. For example, if the incoming substrate profile is thicker near the center of the substrate than at the edges, the configuration of the grooves in the pad 10 may be adjusted accordingly, such as by providing narrower grooves near the center of the pad 10 and wider grooves near the edges of the pad 10, or by providing a larger groove pitch near the center of the pad 10 and smaller groove pitch near the edges of the pad 10. Another polishing rate distribution may be achieved by providing wide grooves (and/or smaller pitch) in the central region of the pad 10, narrower grooves (and/or larger pitch) in the intermediate region, and wide grooves (and/or smaller pitch) in the peripheral region. Yet another polishing rate distribution may be achieved by providing narrow grooves (and/or larger pitch) in the central region of the pad 10, wider grooves (and/or smaller pitch) in the intermediate region, and narrow grooves (and/or larger pitch) in the peripheral region. Thus, it will be appreciated that the polishing pad 10 may be customized to achieve practically any desired polishing rate distribution simply by adjusting the width and/or the pitch of linear parallel grooves.

Figure 3:
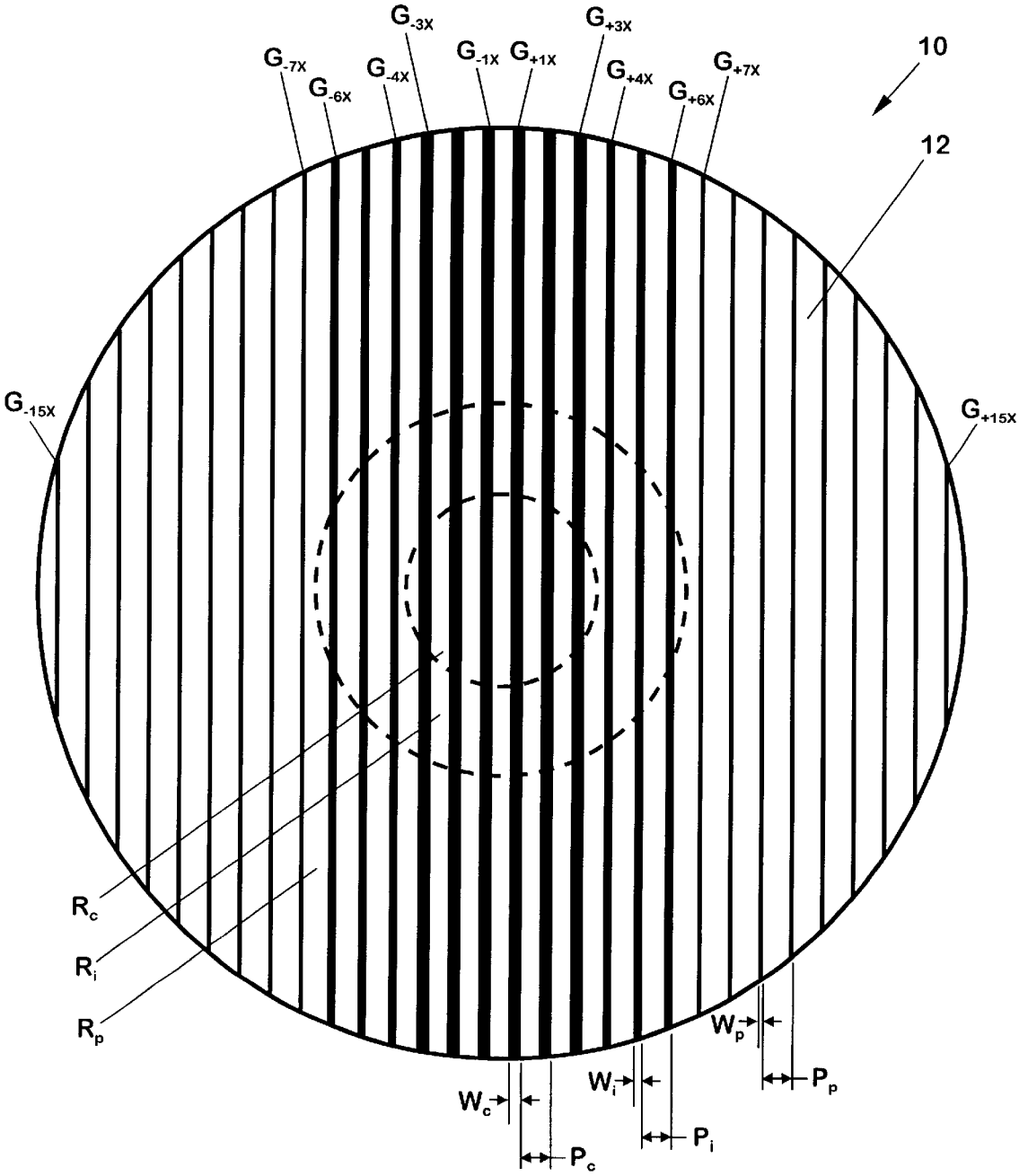
FIG. 3 depicts a plan view of a polishing pad according to yet another alternate embodiment of the present invention.

The two embodiments described above include two orthogonally oriented sets of linear parallel grooves: one horizontal set and one vertical set. However, it will be appreciated that the variations in polishing rate distribution provided by the invention may also be achieved using a single set of parallel grooves, rather than two orthogonal sets of grooves. For example, FIG. 3 depicts an embodiment of the invention having only vertical grooves $G_{-15X}$–$G_{+15X}$ which have a variation in groove width across the surface It is also appreciated that, instead of an orbital pad configuration, where the center of the substrate to be polished is substantially aligned with the center of the pad, and the edges of the pad are substantially aligned with the edges of the substrate, a rotary pad configuration may also be adapted to the present invention. In a rotary pad configuration, the pad typically has a diameter that is something greater than about twice the diameter of the substrate to be polished, although other polishing pad diameters are possible. Thus, the different regions of groove width and spacing as described above can be adapted to such a polishing pad so that edges of the substrate are predominantly polished by central and peripheral regions of the polishing pad, and the center of the substrate is predominantly polished by an intermediate region of the polishing pad, thus accomplishing the objectives as described above.

In this embodiment, the grooves in the intermediate portion of the polishing pad may have some combination of larger widths and narrower spacing than those grooves that are in the central portion of the polishing pad and those grooves that are in the peripheral portion of the polishing pad. This would tend to remove less material from the center of the substrate, and more material from the edges of the substrate. Although it is understood that the grooves preferably extend completely across the polishing pad, and thus all grooves extend through the peripheral portions of the polishing pad, the location of a groove is in large measure designated by the radial distance of the center of the length of the groove from the center of the polishing pad.

Thus, if the center of the length of a groove is at a radial distance from the center of the polishing pad that is near the periphery of the polishing pad, then the groove is considered to be within a peripheral region of the polishing pad. Similarly, if the center of the length of a groove is at a radial distance from the center of the polishing pad that is near the center of the polishing pad, then the groove is considered to be within a central region of the polishing pad. To complete the explanation, if the center of the length of a groove is at a radial distance from the center of the polishing pad that is at an intermediate distance between the center of the polishing pad and the periphery of the polishing pad, then the groove is considered to be within an intermediate region of the polishing pad.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A polishing pad for use in chemical mechanical polishing of a substrate, the polishing pad comprising a substantially flat disk having a polishing surface for contacting the substrate, the polishing surface having a central region and a peripheral region, the polishing surface segmented by a first set of substantially parallel linear grooves directed in a first direction and a second set of substantially parallel linear grooves directed in a second direction that is different from the first direction, the first set of substantially parallel linear grooves comprising:

first central grooves having first central groove dimensions including a first central groove width and pitch, the first central grooves traversing the central region of the polishing surface, and first peripheral grooves having first peripheral groove dimensions including a first peripheral groove width and pitch, the first peripheral grooves traversing the peripheral region of the polishing surface, where at least one of the first central groove dimensions is different from a corresponding first peripheral groove dimension, and the second set of substantially parallel linear grooves comprising:

second central grooves having second central groove dimensions including a second central groove width and pitch, the second central grooves traversing the central region of the polishing surface, and second peripheral grooves having second peripheral groove dimensions including a second peripheral groove width and pitch, the second peripheral grooves traversing the peripheral region of the polishing surface, where at least one of the second central groove dimensions is different from a corresponding second peripheral groove dimension, where each of the grooves completely crosses the polishing pad and has a uniform width.

2. The polishing pad of claim 1 wherein the first direction is substantially perpendicular to the second direction.

3. The polishing pad of claim 1 wherein first central groove width is greater than the first peripheral groove width, and the second central groove width is greater than the second peripheral groove width.

4. The polishing pad of claim 3 wherein first central groove pitch is substantially equivalent to the first peripheral groove pitch, and the second central groove pitch is substantially equivalent to the second peripheral groove pitch.

5. The polishing pad of claim 1 wherein first central groove pitch is less than the first peripheral groove pitch, and the second central groove pitch is less than the second peripheral groove pitch.

6. The polishing pad of claim 5 wherein first central groove width is substantially equivalent to the first peripheral groove width, and the second central groove width is substantially equivalent to the second peripheral groove width.

7. A polishing pad for use in chemical mechanical polishing of a substrate, the polishing pad comprising a substantially flat disk having a polishing surface for contacting the substrate, the polishing surface having a central region and a peripheral region, the polishing surface segmented by a first set of substantially parallel linear grooves directed in a first direction and a second set of substantially parallel linear grooves directed in a second direction that is different from the first direction, the first set of substantially parallel linear grooves comprising:

first central grooves having first central groove dimensions including a first central groove width and pitch, the first central grooves traversing the central region of the polishing surface, and first peripheral grooves having first peripheral groove dimensions including a first peripheral groove width and pitch, the first peripheral grooves traversing the peripheral region of the polishing surface, where at least one of the first central groove dimensions is different from a corresponding first peripheral groove dimension, the second set of substantially parallel linear grooves comprising:

second central grooves having second central groove dimensions including a second central groove width and pitch, the second central grooves traversing the central region of the polishing surface, and second peripheral grooves having second peripheral groove dimensions including a second peripheral groove width and pitch, the second peripheral grooves traversing the peripheral region of the polishing surface, where at least one of the second central groove dimensions is different from a corresponding second peripheral groove dimension, an intermediate region disposed between the central region and the peripheral region, wherein:

the first set of substantially parallel linear grooves further comprise first intermediate grooves having first intermediate groove dimensions including a first intermediate groove width and pitch, the first intermediate grooves disposed between the first central grooves and the first peripheral grooves, and traversing the intermediate region of the polishing surface, where at least one of the first intermediate groove dimensions is different from a corresponding first central groove dimension and corresponding first peripheral groove dimension, and the second set of substantially parallel linear grooves further comprise second intermediate grooves having second intermediate groove dimensions including a second intermediate groove width and pitch, the second intermediate grooves disposed between the second central grooves and the second peripheral grooves, and traversing the intermediate region of the polishing surface, where at least one of the second intermediate groove dimensions is different from a corresponding second central groove dimension and corresponding second peripheral groove dimension.

8. The polishing pad of claim 7 wherein:

the first intermediate groove width is different from the first central groove width and the first peripheral groove width, and the second intermediate groove width is different from the second central groove width and the second peripheral groove width.

9. The polishing pad of claim 8 wherein:

the first intermediate groove width is less than the first central groove width and greater than the first peripheral groove width, and the second intermediate grove width is less than the second central groove width and greater than the second peripheral groove width.

10. The polishing pad of claim 7 wherein:

the first intermediate groove pitch is different from the first central groove pitch and the first peripheral groove pitch, and the second intermediate groove pitch is different from the second central groove pitch and the second peripheral groove pitch.

11. The polishing pad of claim 10 wherein:

the first intermediate groove pitch is greater than the first central groove pitch and less than the first peripheral groove pitch, and the second intermediate groove pitch is greater than the second central groove pitch and greater less the second peripheral groove pitch.

12. A polishing pad for use in chemical mechanical polishing of a substrate, the polishing pad comprising a substantially flat disk having a polishing surface for contacting the substrate, the polishing surface having a central region and a peripheral region, the polishing surface segmented by a set of substantially parallel linear grooves, the grooves comprising:

central grooves having central groove dimensions including a central groove width and pitch, the central grooves traversing the central region of the polishing surface, and peripheral grooves having peripheral groove dimensions including a peripheral groove width and pitch, the peripheral grooves traversing the peripheral region of the polishing surface, where at least one of the central groove dimensions is different from a corresponding peripheral groove dimensions, where each of the grooves completely crosses the polishing pad and has a uniform width.

13. The polishing pad of claim 12 wherein central groove width is greater than the peripheral groove width.

14. The polishing pad of claim 13 wherein central groove pitch is substantially equivalent to the peripheral groove pitch.

15. The polishing pad of claim 12 wherein central groove pitch is less than the peripheral groove pitch.

16. The polishing pad of claim 15 wherein central groove width is substantially equivalent to the peripheral groove width.

17. A polishing pad for use in chemical mechanical polishing of a substrate, the polishing pad comprising a substantially flat disk having a polishing surface for contacting the substrate, the polishing surface having a central region and a peripheral region, the polishing surface segmented by a set of substantially parallel linear grooves, the grooves comprising:

central grooves having central groove dimensions including a central groove width and pitch, the central grooves traversing the central region of the polishing surface, peripheral grooves having peripheral groove dimensions including a peripheral groove width and pitch, the peripheral grooves traversing the peripheral region of the polishing surface, where at least one of the central groove dimensions is different from a corresponding peripheral groove dimension, and an intermediate region disposed between the central region and the peripheral region, and wherein the set of substantially parallel linear grooves further comprise intermediate grooves having intermediate groove dimensions including an intermediate groove width and pitch, the intermediate grooves disposed between the central grooves and the peripheral grooves, and traversing the intermediate region of the polishing surface, where at least one of the intermediate groove dimensions is different from a corresponding central groove dimension and a corresponding peripheral groove dimension.

18. The polishing pad of claim 17 wherein the intermediate groove width is different from the central groove width and the peripheral groove width.

19. The polishing pad of claim 18 wherein the intermediate groove width is less than the central groove width and greater than the peripheral groove width.

20. The polishing pad of claim 17 wherein the intermediate groove pitch is different from the central groove pitch and the peripheral groove pitch.

21. A polishing pad for use in chemical mechanical polishing of a substrate, the polishing pad comprising:

a substantially flat disk of abrasive material, the disk having a polishing surface for contacting the substrate, the polishing surface constructively divided into annular regions and segmented by orthogonal linear grooves, the grooves having widths and pitches, where the widths and pitches of the grooves in the annular regions of the polishing pad selectively vary from one annular region to another annular region of the polishing pad, where each of the grooves completely crosses the polishing pad and has a uniform width.

* * * * *